US011845522B2

(12) United States Patent
Garthwaite

(10) Patent No.: US 11,845,522 B2
(45) Date of Patent: Dec. 19, 2023

(54) ROBOTIC FISH WITH ONE OR MORE TORQUE REACTION ENGINES

(71) Applicant: Fishboat Incorporated, Bainbridge Island, WA (US)

(72) Inventor: Martin Spencer Garthwaite, Bainbridge Island, WA (US)

(73) Assignee: Fishboat Incorporated, Bainbridge Island, WA (US)

( * ) Notice: Subject to any disclaimer, the term of this patent is extended or adjusted under 35 U.S.C. 154(b) by 267 days.

(21) Appl. No.: 17/160,215

(22) Filed: Jan. 27, 2021

(65) Prior Publication Data

US 2021/0147051 A1 May 20, 2021

Related U.S. Application Data

(63) Continuation-in-part of application No. 16/731,038, filed on Dec. 31, 2019, now Pat. No. 11,148,773.

(60) Provisional application No. 62/966,081, filed on Jan. 27, 2020, provisional application No. 62/787,253, filed on Dec. 31, 2018.

(51) Int. Cl.
*B63H 1/36* (2006.01)
*B63B 35/00* (2020.01)

(52) U.S. Cl.
CPC ..... *B63H 1/36* (2013.01); *B63B 2035/007* (2013.01)

(58) Field of Classification Search
CPC ..... B63H 1/36
See application file for complete search history.

(56) References Cited

U.S. PATENT DOCUMENTS 5,237,952 A * 8/1993 Rowe ..... B63G 8/12 114/280
6,814,634 B2 * 11/2004 Roberts ..... B63H 11/08 440/38
6,835,108 B1 * 12/2004 Gieseke ..... B63H 1/30 440/14
7,822,552 B2 * 10/2010 Bittleston ..... G01V 1/3826 702/14
9,032,900 B2 * 5/2015 Glezer ..... B63G 8/14 114/321
9,822,757 B2 * 11/2017 Magnell ..... F03B 13/10
9,944,363 B2 * 4/2018 Venables ..... G05D 1/0875
2008/0087762 A1 * 4/2008 Holloman ..... B64C 1/0009 244/30
2010/0151751 A1 * 6/2010 Jemt ..... B63H 23/02 440/14
2012/0145066 A1 * 6/2012 King ..... F42B 10/38 114/333
2013/0239869 A1 * 9/2013 Hesse ..... E02F 3/9243 362/477
2014/0261129 A1 * 9/2014 Garthwaite ..... B63H 25/02 114/123
2015/0081146 A1 * 3/2015 Geder ..... B63H 1/37 901/1
2016/0304179 A1 * 10/2016 Garthwaite ..... B63B 21/56
2018/0312234 A1 * 11/2018 Garthwaite ..... B63C 11/46
2018/0342938 A1 * 11/2018 Fei ..... B63H 1/36

(Continued)

*Primary Examiner* — S. Joseph Morano
*Assistant Examiner* — Jovon E Hayes

(57) ABSTRACT

A robotic fish comprises one or more torque reaction engines and a fish body, wherein the torque reaction engine cyclically oscillates and causes a wave to propagate across the fish body, including through a flexible wing, accelerating thrust fluid and propelling the robotic fish.

15 Claims, 21 Drawing Sheets

(56) References Cited

U.S. PATENT DOCUMENTS

| | | | | |
|---|---|---|---|---|
| 2019/0152573 | A1* | 5/2019 | Wiens | B63H 1/36 |
| 2019/0351986 | A1* | 11/2019 | Garthwaite | B63H 1/36 |
| 2019/0360510 | A1* | 11/2019 | Broers | B32B 15/08 |
| 2020/0255108 | A1* | 8/2020 | Garthwaite | B63G 8/08 |

* cited by examiner

805

ROBOTIC FISH WITH ONE OR MORE TORQUE REACTION ENGINES

CROSS-REFERENCE TO RELATED APPLICATIONS

This application claims the benefit of the filing date of and incorporates by reference the content and subject matter of U.S. provisional patent application Ser. No. 62/966,081, filed Jan. 27, 2020, with the title, "Robotic Fish with One or More Torque Reaction Engines" and is a continuation-in-part of U.S. patent application Ser. No. 16/731,038, filed Dec. 31, 2019, which application is a non-provisional of U.S. provisional patent application Ser. No. 62/787,253, filed Dec. 31, 2018, with the title, "Robotic Fish with Multiple Torque Reaction Engines".

SUMMARY

Figure 1:
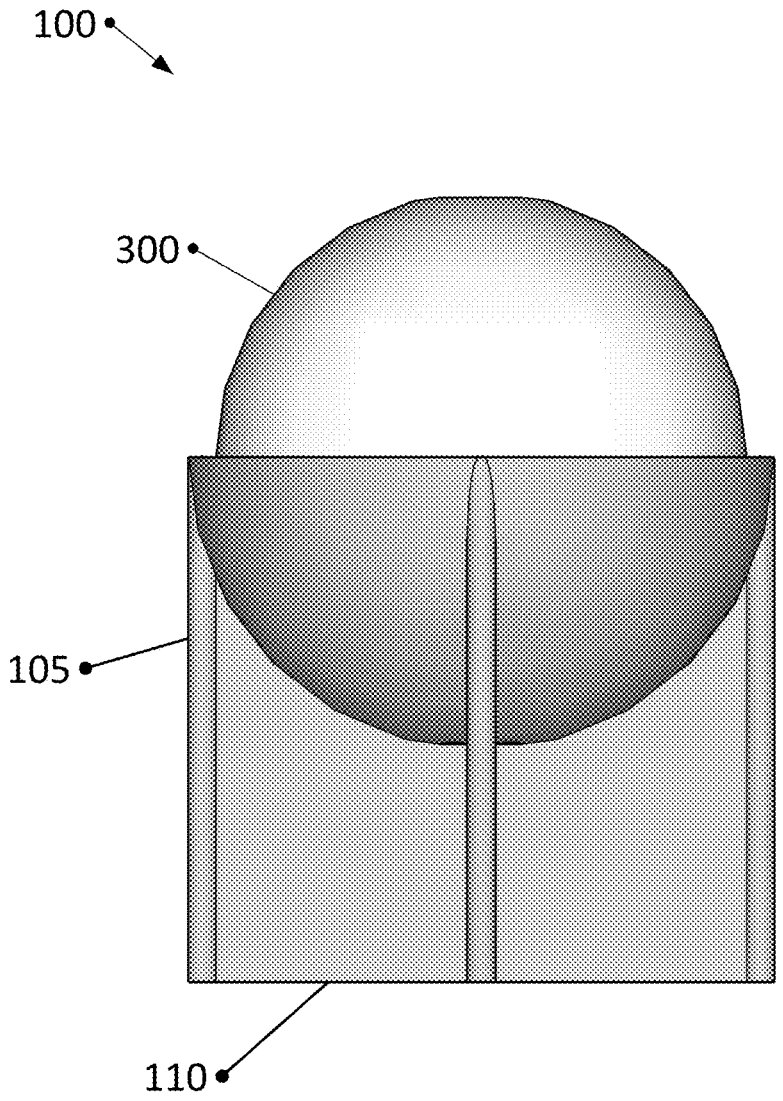
FIG. 1 illustrates a side elevation of a robotic fish including a torque reaction engine, a fin, and a hull cradle, in accordance with an embodiment.

Certain of the inventions disclosed herein comprise systems and apparatus to accelerate thrust fluid with a wing driven by one or more torque reaction engines (TREs).

DETAILED DESCRIPTION

It is intended that terminology used in the description presented below be interpreted in broadest reasonable manner, even though used in conjunction with a detailed description of certain examples. Although certain terms may be emphasized below, any terminology intended to be interpreted in any restricted manner will be overtly and specifically defined as such in this Detailed Description section.

The figures and text herein illustrate and discuss examples of a craft that interacts with thrust fluid like a fish, through use of one or more one torque reaction engine (TRE) secured to a fin.

As discussed herein, "thrust fluid" may include a gas, a liquid, a plasma or other media comprising mass, wherein the media may be accelerated by a moving fin, propeller, sheer or tubular curtain, or the like ("fin"), and wherein the fin may be moved by a TRE or wherein the thrust fluid is of a stream of thrust fluid and the stream of thrust fluid moves the fin and generates power with the TRE.

As used herein, "releasable," "connect," "connected," "connectable," "disconnect," "disconnected," and "disconnectable" refers to two or more structures which may be connected or disconnected, generally without the use of tools or chemical or physical bonding (examples of tools including screwdrivers, pliers, drills, saws, welding machines, torches, irons, and other heat sources) and generally in a repeatable manner. As used herein, "attach," "attached," or "attachable" refers to two or more structures or components which are attached through the use of tools or chemical or physical bonding. As used herein, "secure," "secured," or "securable" refers to two or more structures or components which are either connected or attached.

U.S. patent application Ser. No. 15/101,901 discloses a torque reaction engine (TRE), which may be used in a watercraft to achieve a fish-like motion. The resulting craft swims like a fish or marine mammal, without the myriad parts that plague other mechanical craft that attempt to swim like a fish or marine mammal.

As used herein, a central shaft may also be or be referred to as a "rotor" or a "drive shaft" and the inertial mass may be or may be referred to as a "stator". These identifiers are somewhat arbitrary, except inasmuch as they distinguish a first component and a second component, wherein one of the two components carries an inertial mass, and wherein the first and second components may rotate relative to one another around a common axis.

As discussed herein, each torque reaction engine (TRE) comprises a central shaft (or "driveshaft") secured to a portion of a hull, beam, and/or fin of a craft (collectively referred to as "hull"), an inertial mass radially arrayed around or within the central shaft, wherein an engine may be located between and/or may comprise the inertial mass and the central shaft. The engine causes the inertial mass to change its acceleration around, within, or relative to the central shaft, such as by slowing down, speeding up, or reversing rotation of the inertial mass. A bearing or set of bearings may be located between the inertial mass and the driveshaft. The bearing or set of bearings may allow the inertial mass and driveshaft to rotate relative to one another; rotation of these components relative to one another may include rotation about a common central axis of rotation. The inertial mass may comprise, for example, lead, iron, steel, a pack of batteries, layers of lithium polymer (LiPo) batteries and lead, a lead-acid paste battery, a lead-acid paste battery in a toroidal shape, a LiPo battery in a toroidal shape, another battery chemistry in a toroidal shape, an electromagnet, a heavy or dense object, and the like. Torque reaction produced on the central shaft by change in acceleration of the inertial mass by the engine causes the central shaft and the hull (or portion of hull) secured to such central shaft to rotate, opposite the change in acceleration of the inertial mass.

The central shaft may be secured to the interior of an isolation or pressure vessel. The pressure vessel may contain the TRE and form its exterior surface that is secured to the remainder of the hull. The pressure vessel is also referred to herein as "portion of a hull". The pressure vessel may seal the electronic components away from the surrounding thrust fluid, such as surrounding water.

Unlike conventional craft that accelerate thrust fluid through use of a propeller or other fin connected to a motor via an external driveshaft, there may be no penetration in the pressure vessel of a TRE for a moving component, such as a driveshaft. In conventional inboard watercraft, the driveshaft typically penetrates the hull, requiring a seal around the spinning driveshaft. The driveshaft seal presents a problem for conventional craft. It can leak and degrade. It is a source of friction. It costs money to fabricate and maintain. In craft that go deep in water (e.g., more than several hundred feet), to prevent high pressure water from leaking through the driveshaft seal, a complex labyrinth seal may be used or an electric motor connected to the propeller may be flooded with oil. The labyrinth seal or oil may prevent water from contaminating the motor; however, labyrinth seals still have depth limitations and are a source of drive train friction and flooding a motor with oil significantly decreases operating efficiency. Penetrations in the hull to accommodate a moving component such as a driveshaft are a real and severe problem that limits depth and operating range.

In contrast in a TRE, there does not have to be a penetration in the pressure vessel or hull for a moving component, because the central shaft (or driveshaft) is secured to the interior of the pressure vessel.

The pressure vessel may be toroidal in shape, such that a passage passes through a center of the central shaft. However, the passage through the center of the central shaft in a toroidal pressure vessel does not penetrate the toroidal pressure vessel. Such a passage may be used to secure a harness to the craft, to exhaust heat from the TRE, as a location for environmental sensors, or as a conduit for transmitting data, signals, or power into an interior of the TRE, or as a location for fins.

The engine may be located between and/or may comprise one or more of the inertial mass and the driveshaft. The engine causes the inertial mass to change its acceleration vector relative to the driveshaft, such as by slowing down, speeding up, or reversing rotation of the inertial mass relative to the driveshaft. Torque reaction produced on the driveshaft by change in acceleration vector of the inertial mass by the engine causes the driveshaft and portion of the hull secured to such driveshaft to experience a torque reaction. If the portion of the hull is not held in place by an external object, the torque reaction on the driveshaft will cause the portion of the hull to rotate, opposite an acceleration vector of the inertial mass.

The TRE may be controlled by a controller to cyclically reverse an acceleration vector of the inertial mass. Torque reaction on the driveshaft by cyclic reversal of the acceleration vector of the inertial mass causes the driveshaft to cyclically rotate in a first direction (such as clockwise), then in a second direction (such as counterclockwise), then in the first direction, etc., opposite the acceleration vector of the inertial mass, so long as power is available and the controller comprises suitable instructions. Cyclic rotation of the driveshaft in the first and second directions may be referred to herein as, "cyclic oscillation".

During a first phase of operation of a TRE, the motor may apply power to accelerate the inertial mass. During a second phase of operation of the TRE, the motor may apply a brake to decelerate the inertial mass. The motor may be an electric motor or an internal combustion motor. The brake may generate power, such as when the motor is an electric motor and the brake is an electronic or magnetic brake or such as when the motor is an internal combustion engine and the brake compresses a system to compress gas or accelerate a fly wheel.

In an example discussed herein, the driveshaft of a TRE is secured to a craft, such as a hull of the craft, a pressure vessel and/or isolation capsule surrounding the TRE, a beam, or the like ("beam" or "pressure vessel"). At least a fin is secured to the pressure vessel. Cyclic oscillation of the driveshaft is communicated to the fin by the pressure vessel, resulting in translation and/or rotation of the fin, back and forth, through a surrounding thrust fluid, resulting in acceleration of the thrust fluid. Acceleration of thrust fluid results in thrust and/or lift on the fin, which may propel the craft. The TRE may be operated in reverse, to generate power from a moving stream of thrust fluid surrounding a TRE-containing craft.

A flexible material secured to the driveshaft may flex in response to movement of the driveshaft. Such flex may compress and/or expand the flexible material, such as between at least first and second shapes. The flexible material may store energy as it compresses or expands. The flexible material may release stored energy and return to an original or resting shape, as may occur when the central shaft stops moving; alternatively, the flexible material may be pliable and/or may not store appreciable energy. The flexible material may have one or more states of strain deformation. The flexible material may transition between at least first and second shapes in response to or as allowed by movement of at least a first and a second TRE and/or in response to or as allowed by release or storage of energy in the flexible material, which may result in movement of strain deformations along the flexible material.

The flexible material may comprise rubber, polyurethane, nylon, carbon fiber, carbon fiber embedded in resin, gelatin, gelatin produced by a living organism, fiberglass, aramid, or the like.

The flexible material may have a first shape, wherein the first shape may be the shape of a curtain, a curtain comprising a wave due to a strain deformation, a tubular curtain, a beam, or the like, wherein the first shape may be a resting shape, and/or wherein the first shape may store or comprise a different amount of energy relative to a second shape, wherein the energy may be potential energy.

The flexible material may have at least a second shape. The second shape may be a mirror image of the first shape, and/or a compressed, stretched, expanded, or bent version of the first shape.

Transition between the first and second shapes may be caused by and/or may produce a wave. The wave may traverse the flexible material or may be a standing wave in the flexible material. The wave may store or release energy in a local portion of the flexible material. The wave may be produced by a movement of at least one TRE. One TRE may move relative to at least a second TRE; movement of more than one TRE may be in phase or out of phase.

One or more tendons may span between the TRE and the flexible material. The tendons may hold the TRE within the craft and/or the wing to the TRE. The tendons may comprise fibers, rods, or the like. Rods may comprise joints, such as at the ends of the rods, where the rods contact the TRE and the flexible material.

Flexure of the curtain caused by a TRE may cause a wave to propagate along the curtain; more than one TRE may move relative to one another to cause a propagating wave ("wave") or a standing wave to form in the curtain between at least two of the TREs. Propagation of the wave along the curtain may be performed to accelerate thrust fluid and produce thrust. Production of a standing wave may be performed to bend the curtain. Bending the curtain may be performed to steer the craft. Production of the propagating wave and production of the standing wave may be performed simultaneously.

FIG. 1 illustrates a side elevation of robotic fish 100 including torque reaction engine 300, fin 110, and hull cradle 105, in accordance with an embodiment.

Figure 2:
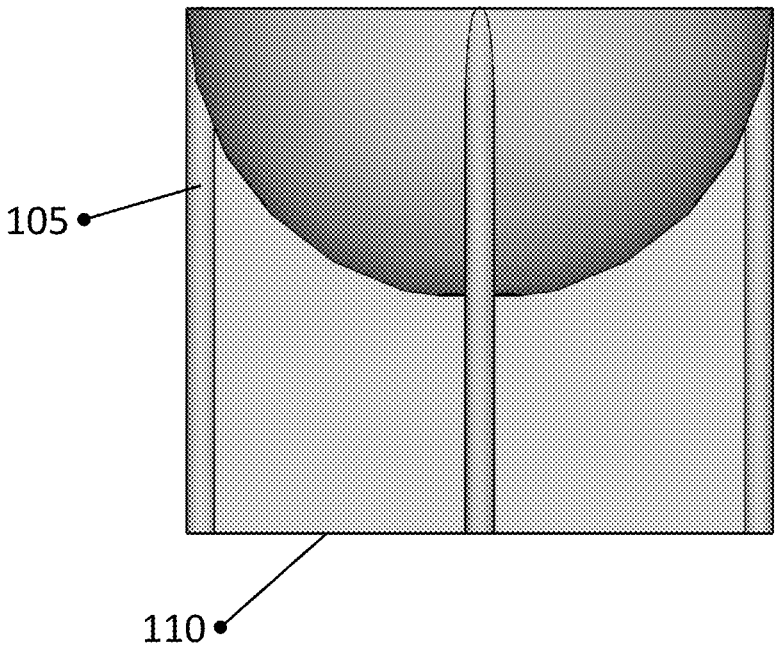
FIG. 2 illustrates a side elevation of the fin and hull cradle of FIG. 1, in accordance with an embodiment.

FIG. 2 illustrates a side elevation of fin 110 and hull cradle 105 of FIG. 1, in accordance with an embodiment.

Figure 3:
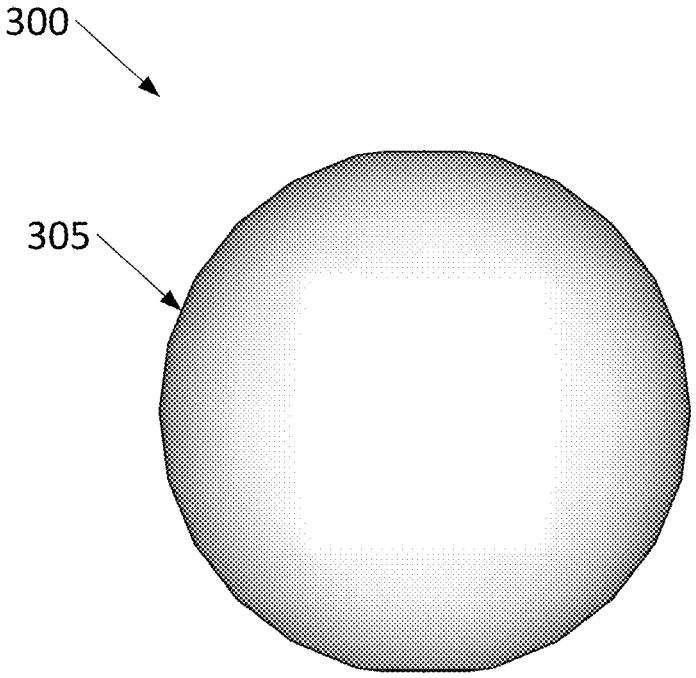
FIG. 3 illustrates a side elevation of a hull of a torque reaction engine, in accordance with an embodiment.

FIG. 3 illustrates a side elevation of hull 305 of torque reaction engine 300, in accordance with an embodiment.

Figure 4:
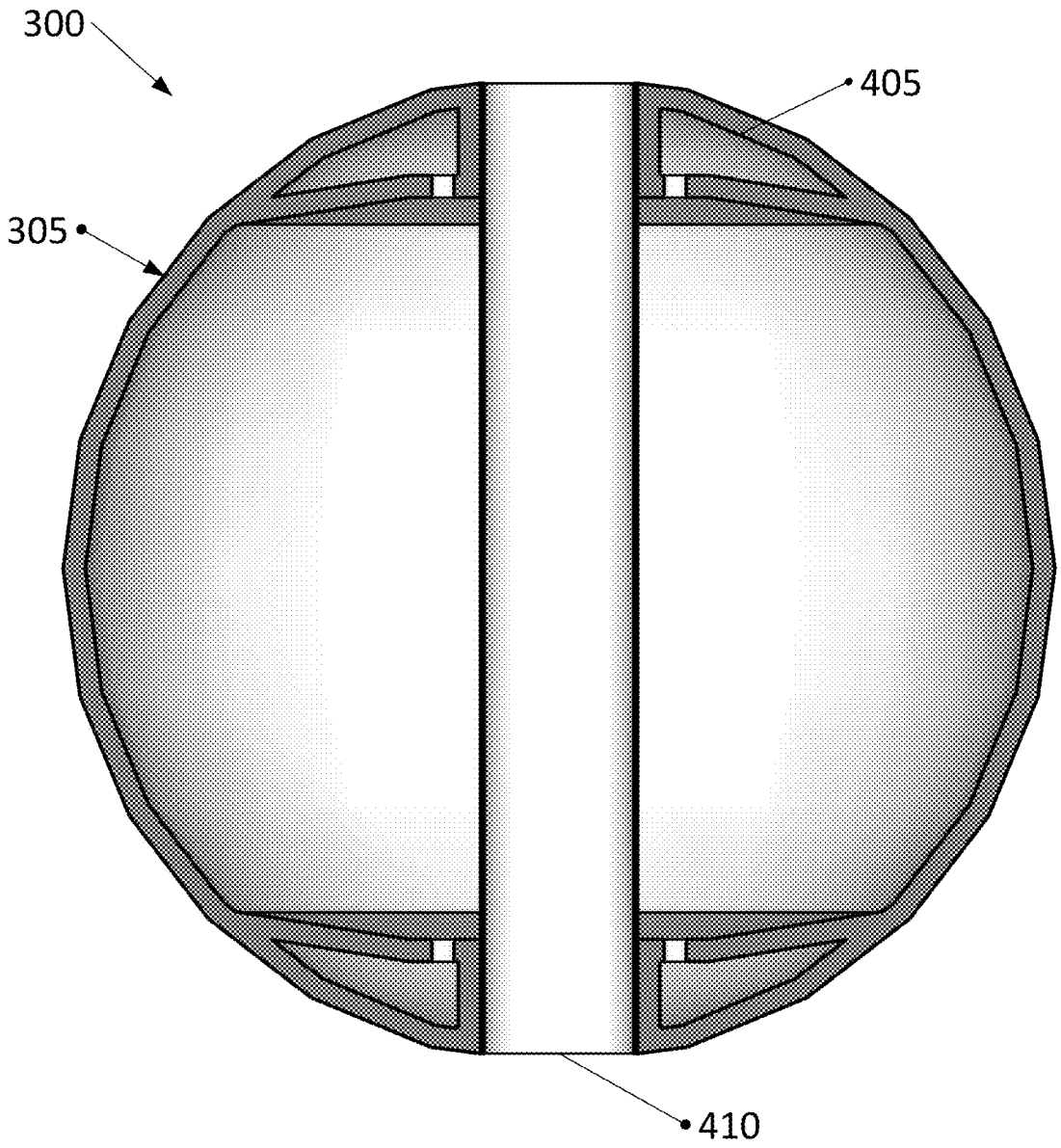
FIG. 4 illustrates a side elevation of the torque reaction engine of FIG. 3, with a section view of internal components, in accordance with an embodiment.

FIG. 4 illustrates a side elevation of hull 305 of FIG. 3, with a section view of internal components comprising ballast 405 and central pipe or central passage 410, in accordance with an embodiment.

Figure 5:
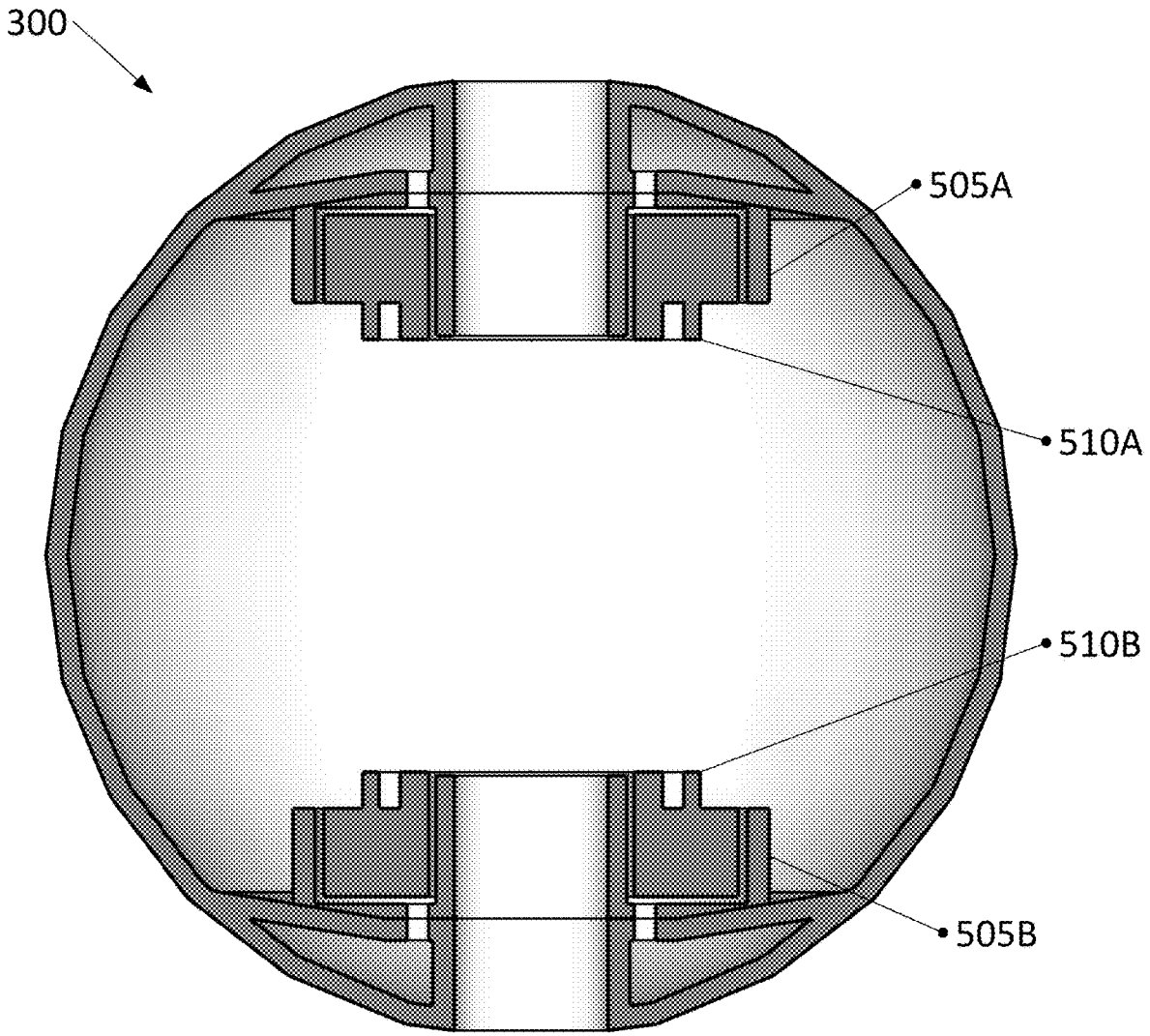
FIG. 5 illustrates a side elevation of the torque reaction engine of FIG. 3, with a section view of internal components, in accordance with an embodiment.

FIG. 5 illustrates a side elevation of torque reaction engine 300 of FIG. 3, with a section view of internal components comprising rotor 505 and stator 510, in accordance with an embodiment. In the illustrated embodiment, two rotors, rotor 505A and rotor 505B, and two stators, stator 510A and stator 510B are used.

Figure 6:
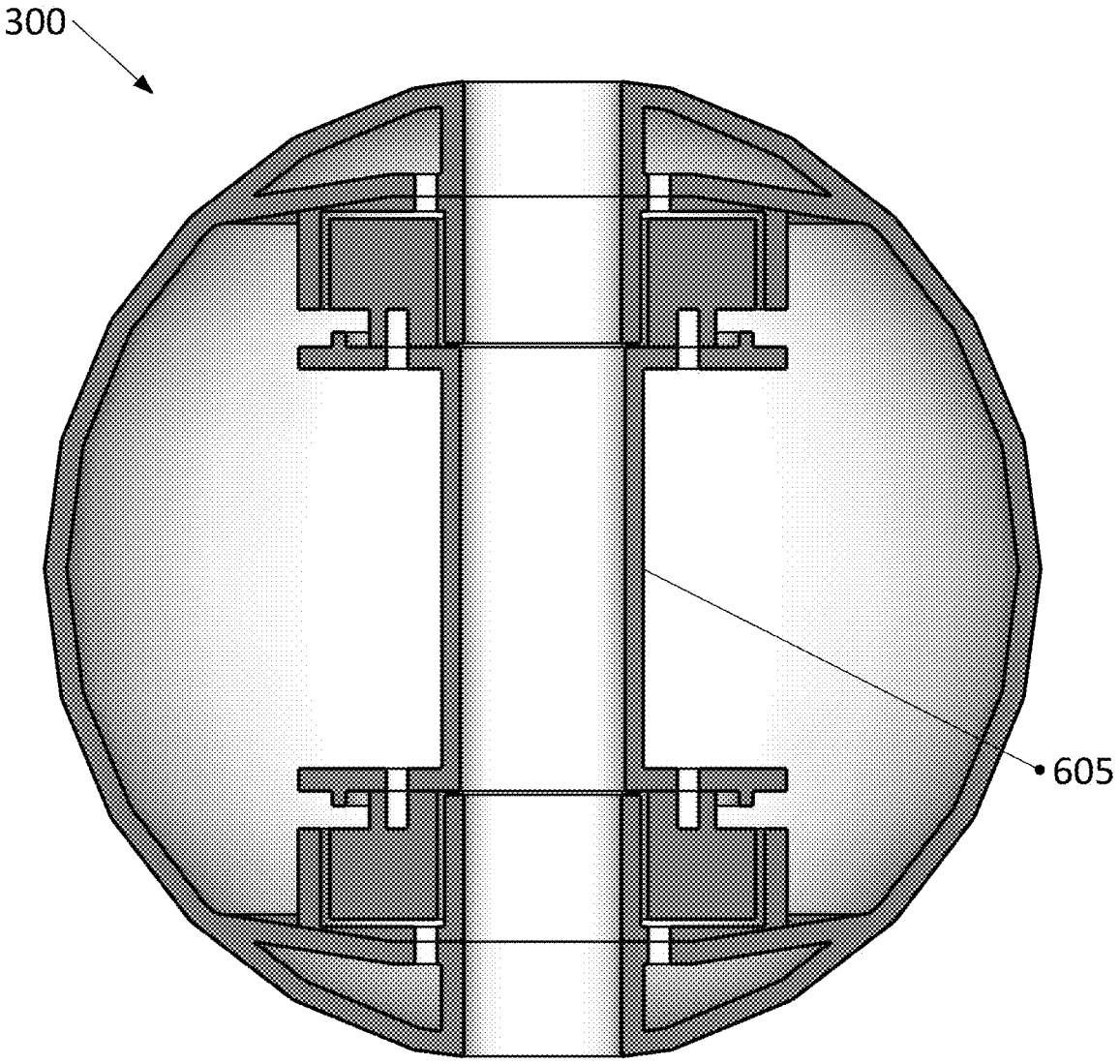
FIG. 6 illustrates a side elevation of the torque reaction engine of FIG. 3, with a section view of internal components, in accordance with an embodiment.

FIG. 6 illustrates a side elevation of torque reaction engine 300 of FIG. 3, with a section view of internal components comprising motor frame 605, in accordance with an embodiment.

Figure 7:
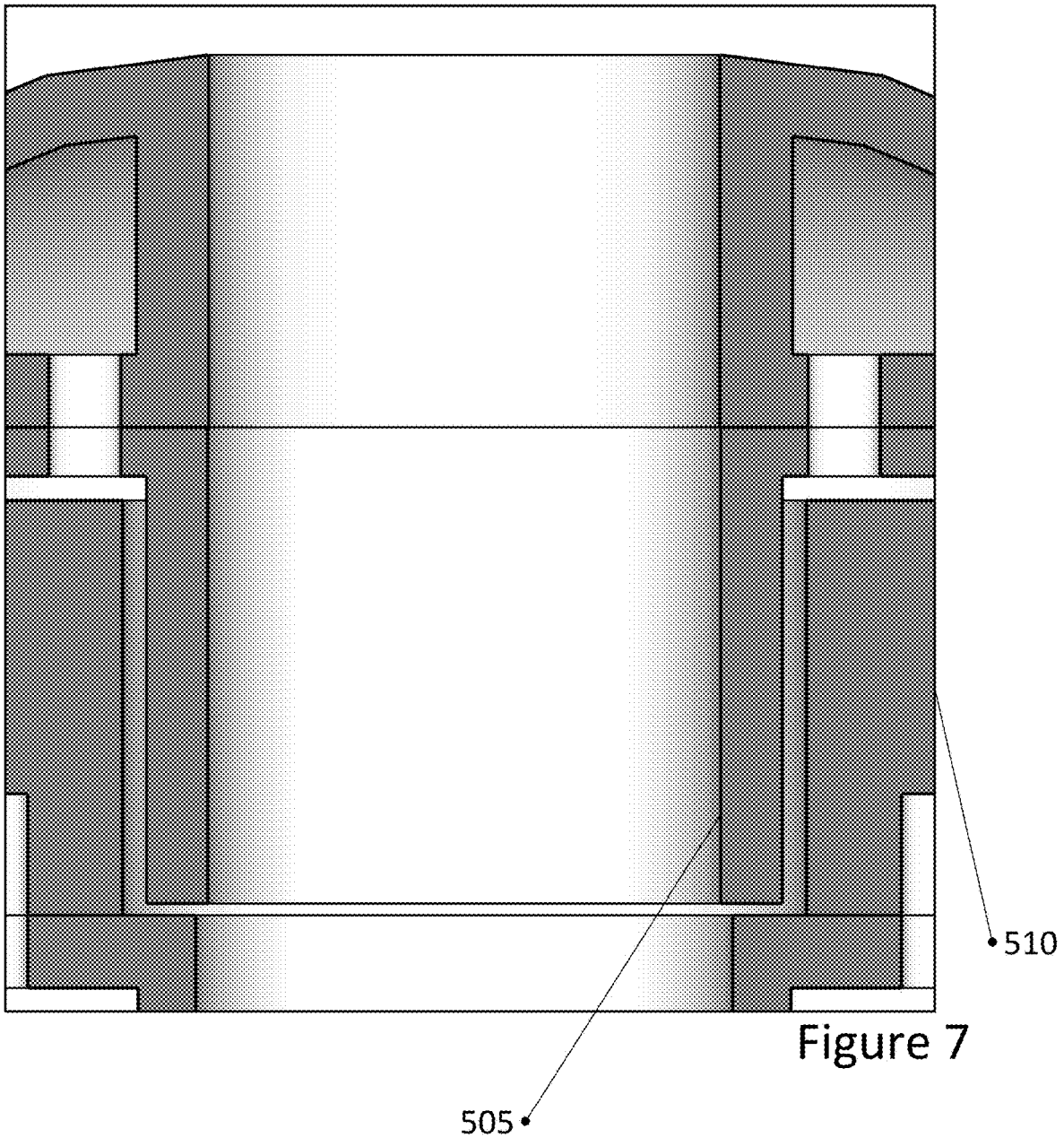
FIG. 7 illustrates a side elevation of a detail of FIG. 6, with a section view of internal components, in accordance with an embodiment.

FIG. 7 illustrates a side elevation of a detail of FIG. 6, with a section view of internal components comprising rotor 505 and stator 510, in accordance with an embodiment.

Figure 8:
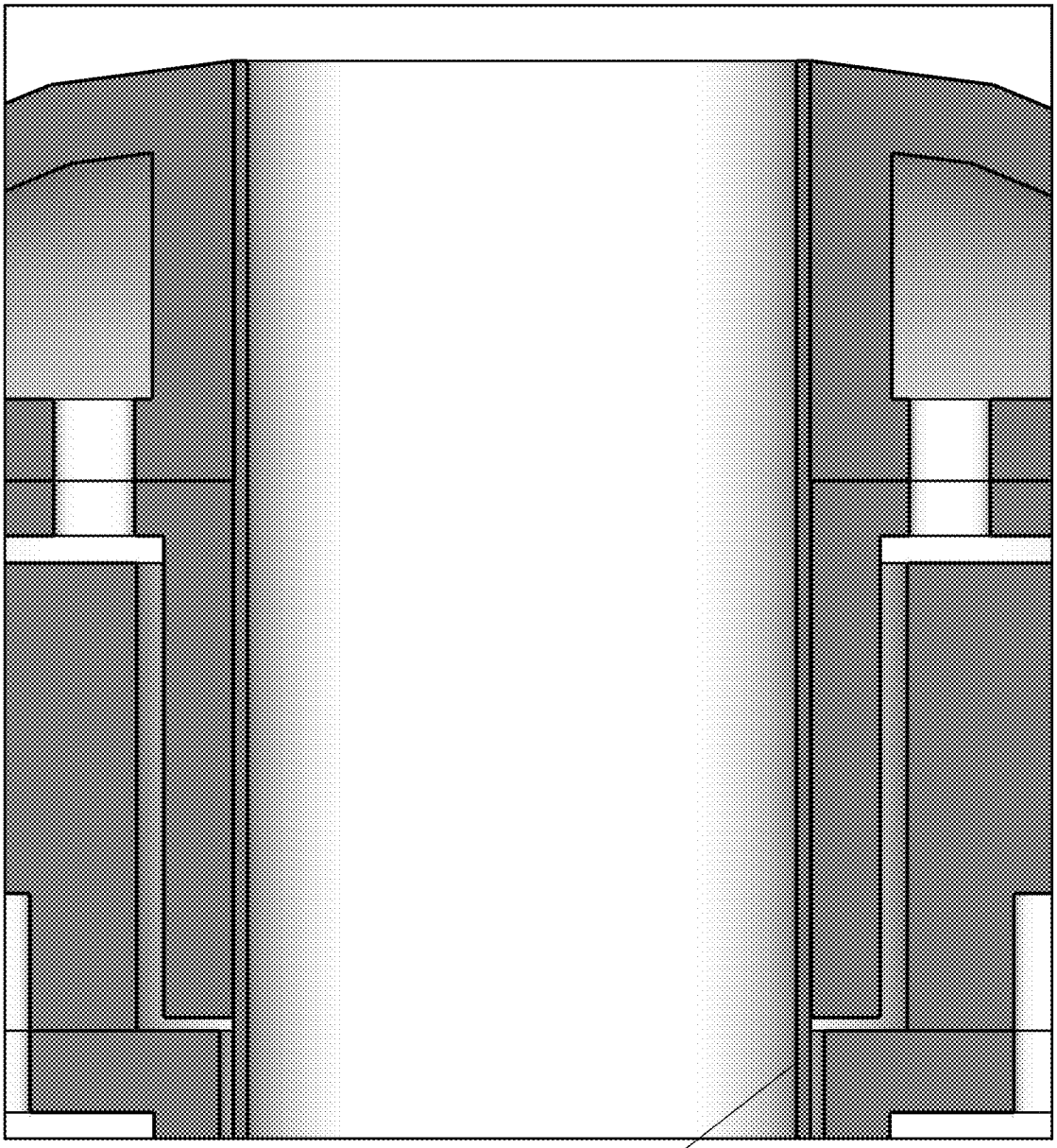
FIG. 8 illustrates a side elevation of a detail of FIG. 6, with a section view of internal components, in accordance with an embodiment.

FIG. 8 illustrates a side elevation of a detail of FIG. 6, with a section view of internal components comprising inner rotor pipe 805, in accordance with an embodiment.

Figure 9:
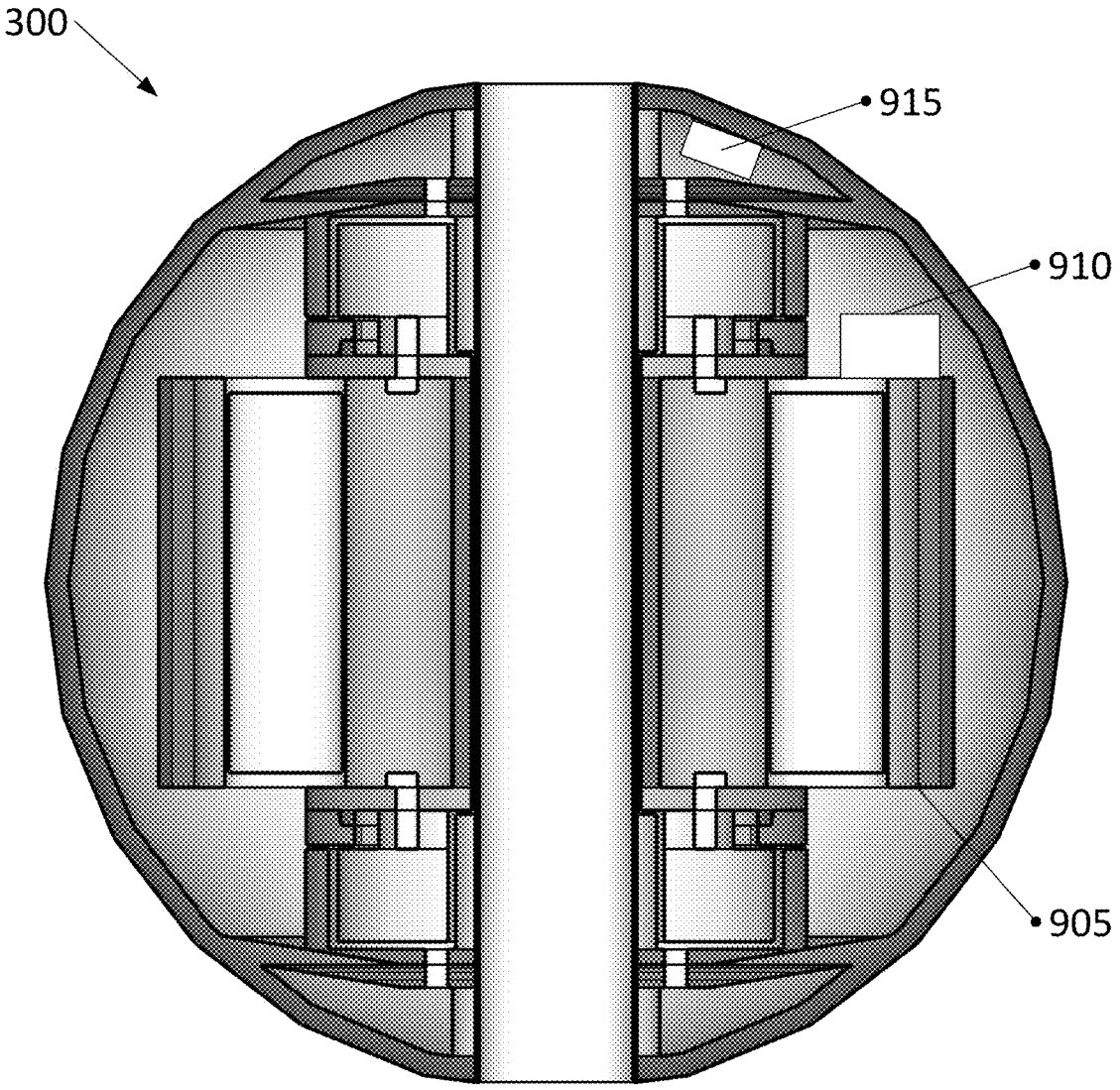
FIG. 9 illustrates a side elevation the torque reaction engine of FIG. 3, with a section view of internal components, in accordance with an embodiment.

FIG. 9 illustrates a side elevation of torque reaction engine 300 of FIG. 3, with a section view of internal components comprising battery frame 905, internal control circuit 910, and external control circuit 915, in accordance with an embodiment. Internal control circuit 910 and external control circuit 915 may act as a TRE motor controllers. Internal control circuit 910 may be directly connected to batteries and the motors, such as to electromagnets in stator 510. Internal control circuit 910 may comprise a power controller, such as an electronic speed controller or the like. Internal control circuit 910 may expose a suite of primitive or base-level control parameters to external control circuit 915. External control circuit 915 may transmit instructions to internal control circuit 910, such as using the control parameters exposed by internal control circuit 910. Transmission may be wireless or wireline, such as through a slip ring or the like. External control circuit 910 may be connected to sensors, such as pressure sensors, acceleration sensors, acoustic sensors, long-distance communication sensor and/or transceivers and the like discussed herein, as well as to other external control circuits of other TREs in a matrix or array of TREs. External control circuit 915 may process sensor information to develop instructions to transmit to internal control circuit 910.

Figure 10:
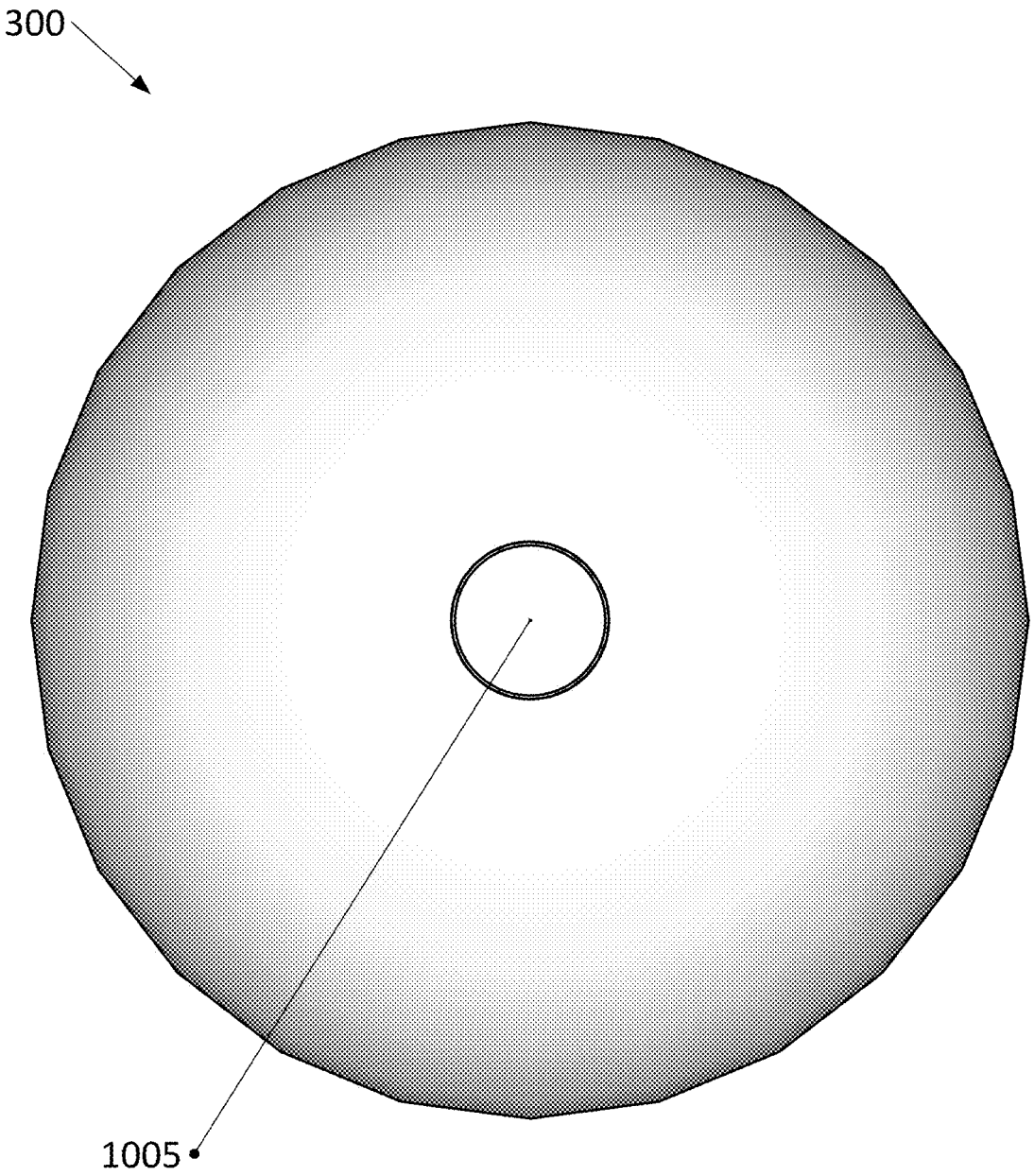
FIG. 10 illustrates a top view the torque reaction engine of FIG. 3, with a section view of internal components, in accordance with an embodiment.

FIG. 10 illustrates a top view the torque reaction engine of FIG. 3, with a section view of internal components comprising central passage 1005, which passes through inner rotor pipe 805, in accordance with an embodiment.

Figure 11:
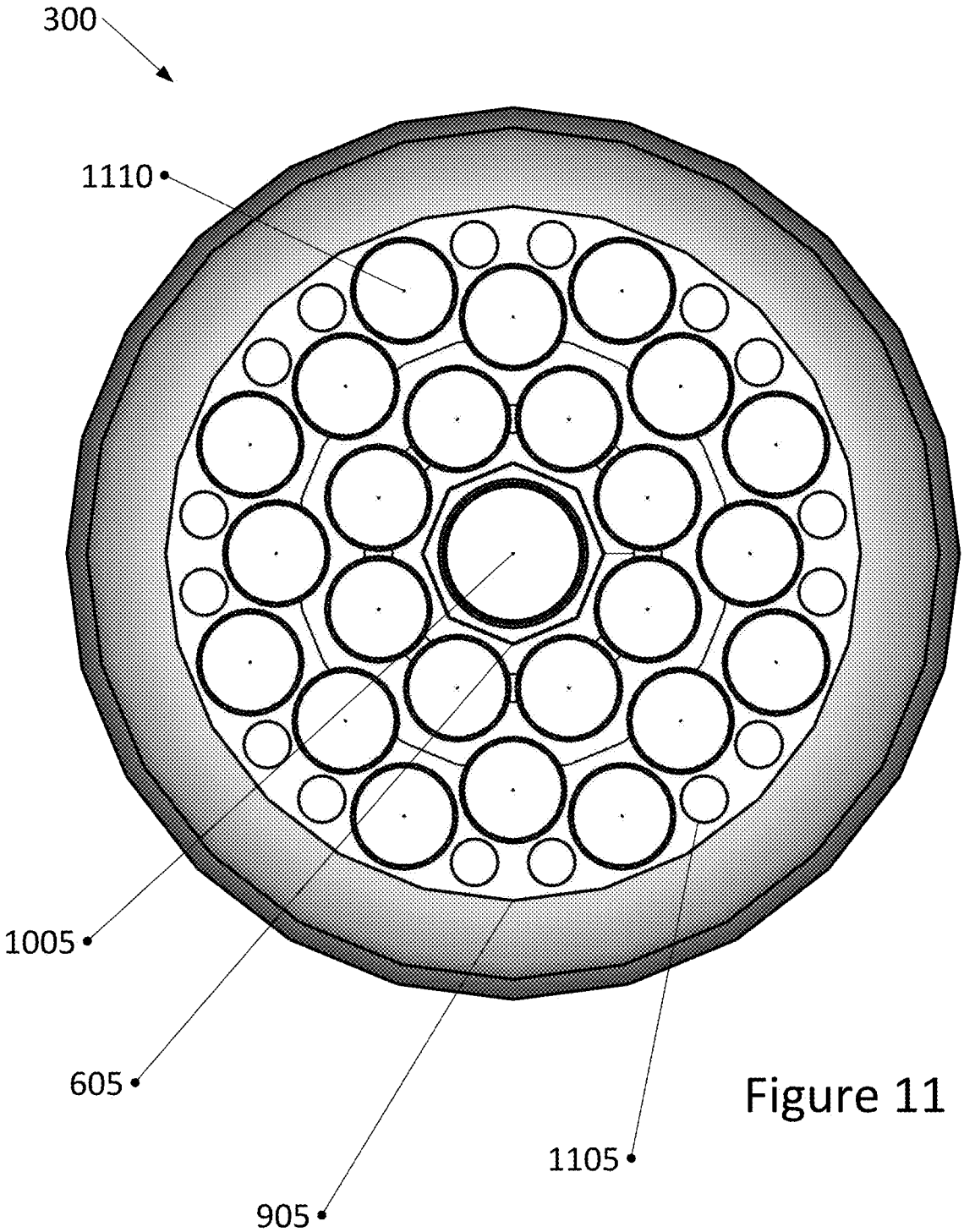
FIG. 11 illustrates a top view the torque reaction engine of FIG. 3, with a section view of internal components, in accordance with an embodiment.

FIG. 11 illustrates a top view of torque reaction engine 300 of FIG. 3, with a section view of internal components comprising central passage 1005, motor frame 605, battery frame 905, lead 1105, and battery 1110, in accordance with an embodiment.

Figure 12:
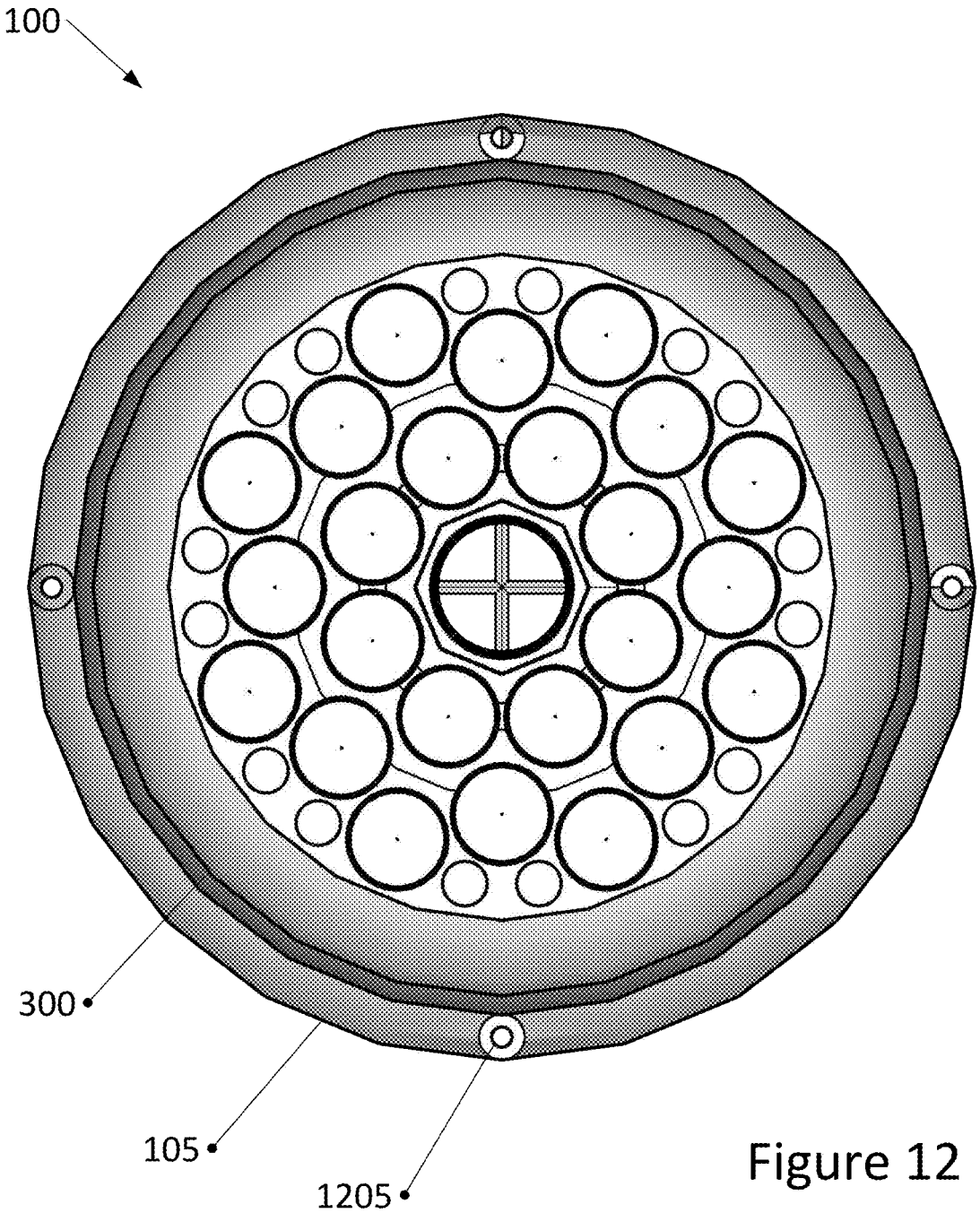
FIG. 12 illustrates a top view the torque reaction engine of FIG. 3, with a section view of internal components, fin, and fin cradle, in accordance with an embodiment.

FIG. 12 illustrates a top view of robotic fish 100, with a section view of internal components, comprising TRE 300, fin tendon 1205, and fin cradle 105, in accordance with an embodiment.

Figure 13:
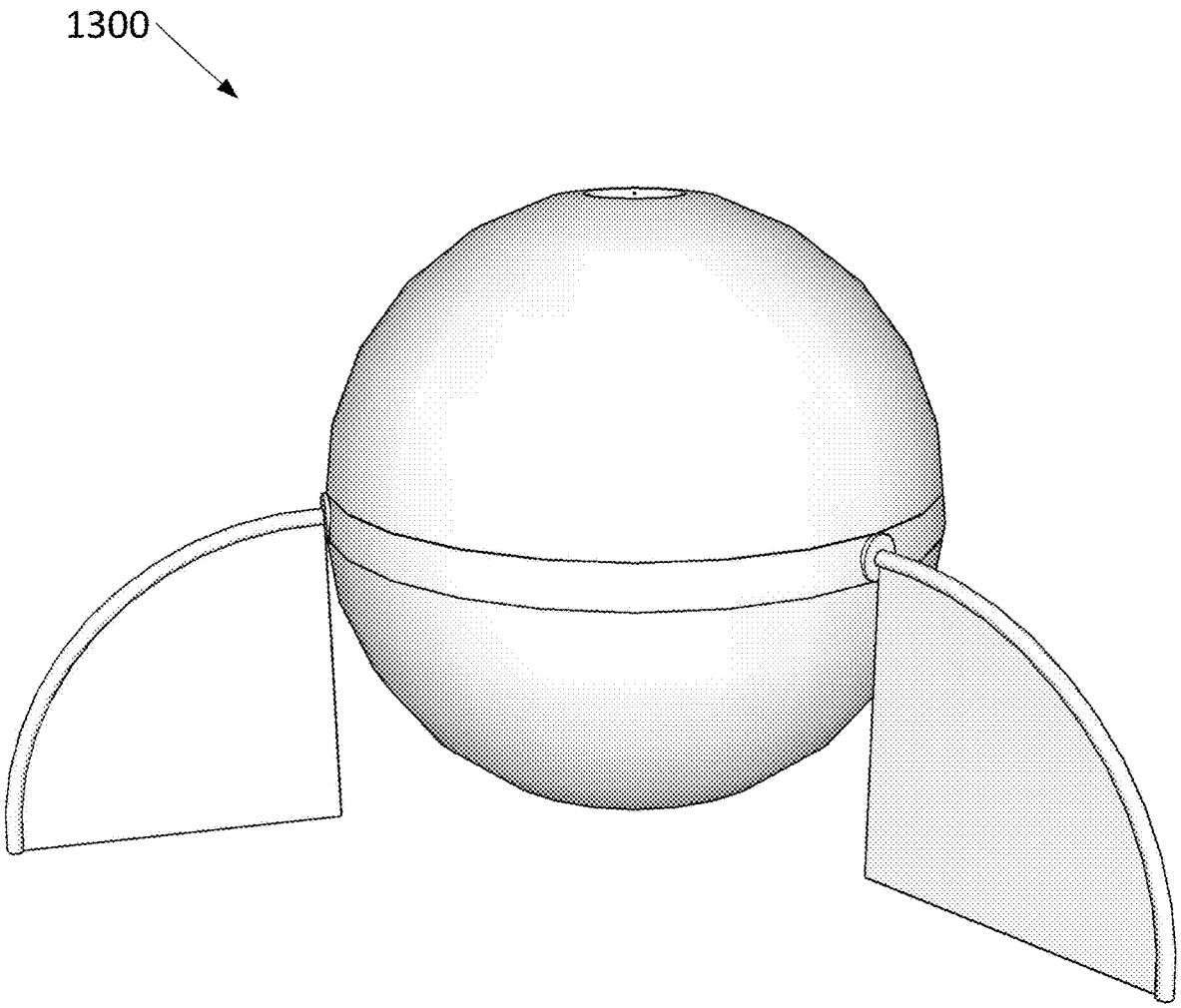
FIG. 13 illustrates an oblique view of a robotic fish comprising three fins, in accordance with an embodiment.

FIG. 13 illustrates an oblique view of robotic fish comprising three fins 1300, in accordance with an embodiment.

Figure 14:
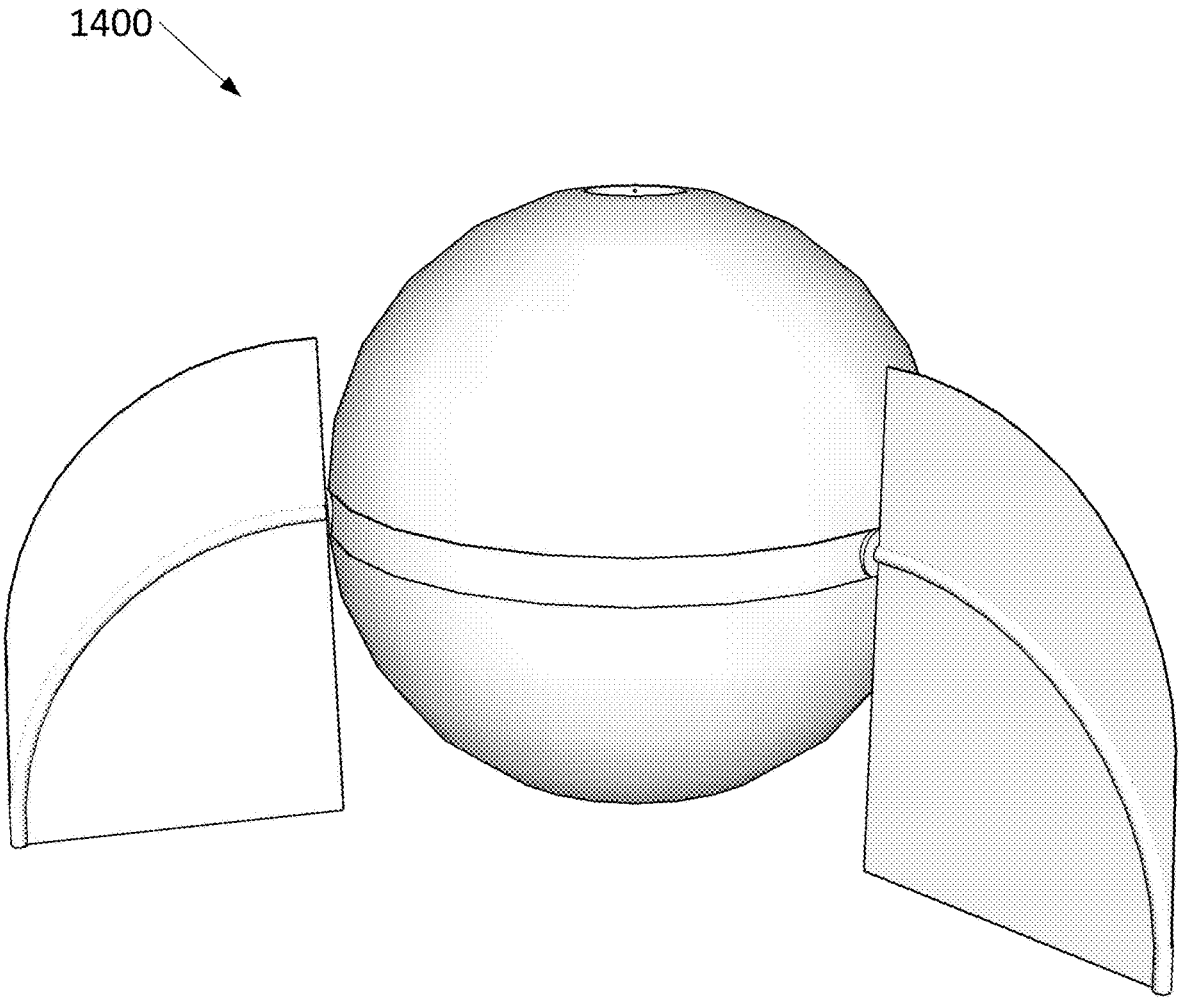
FIG. 14 illustrates an oblique view of a robotic fish comprising three fins, in accordance with an embodiment.

FIG. 14 illustrates an oblique view of robotic fish comprising three fins 1400, in accordance with an embodiment.

Figure 15:
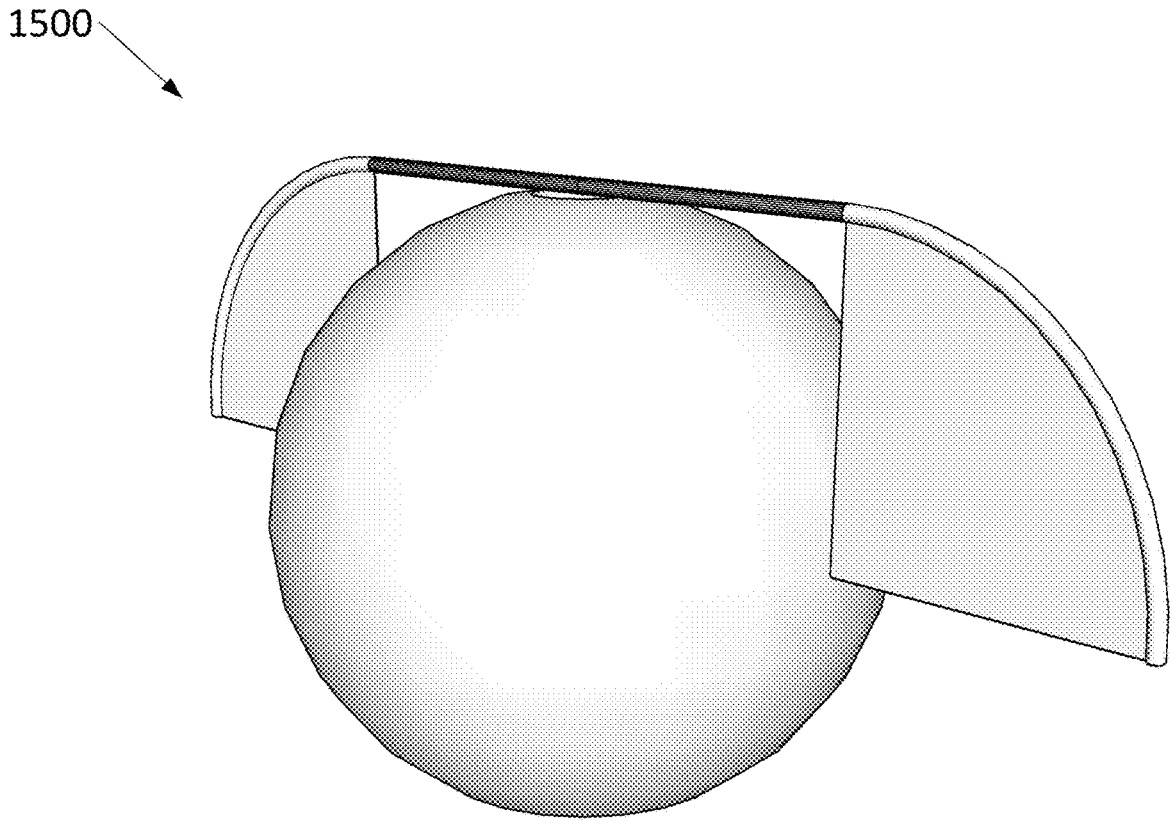
FIG. 15 illustrates an oblique view of a robotic fish comprising two fins, in accordance with an embodiment.

FIG. 15 illustrates an oblique view of robotic fish comprising two fins 1500, in accordance with an embodiment.

Figure 16:
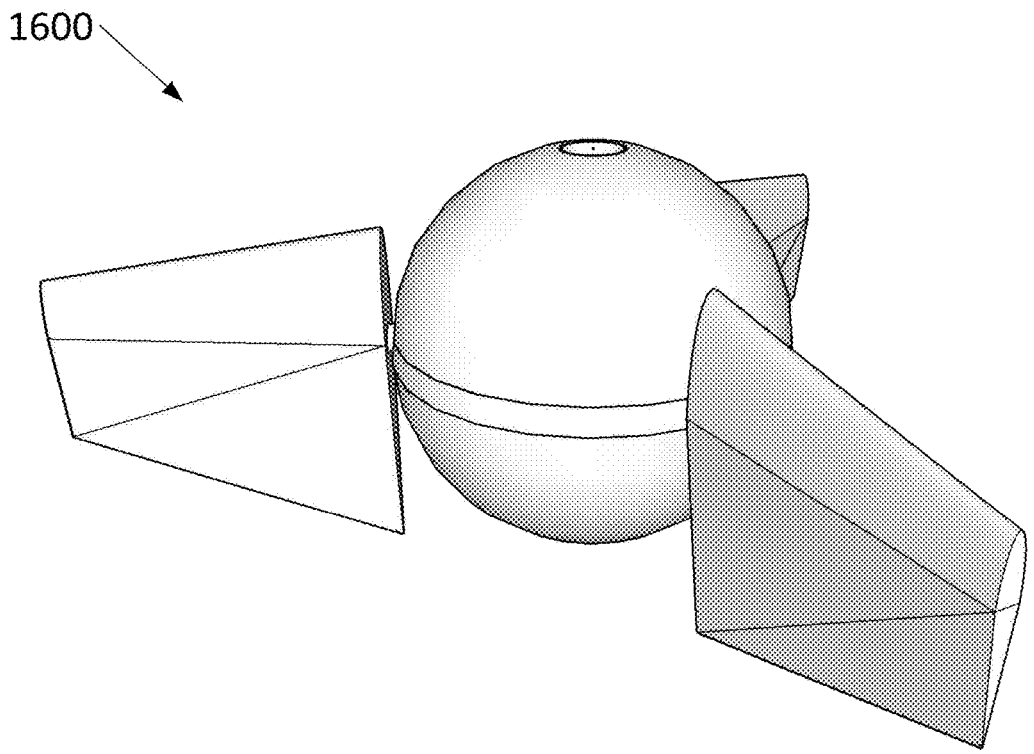
FIG. 16 illustrates an oblique view of a robotic fish comprising three fins, in accordance with an embodiment.

FIG. 16 illustrates an oblique view of robotic fish comprising three fins 1600, in accordance with an embodiment.

Figure 17:
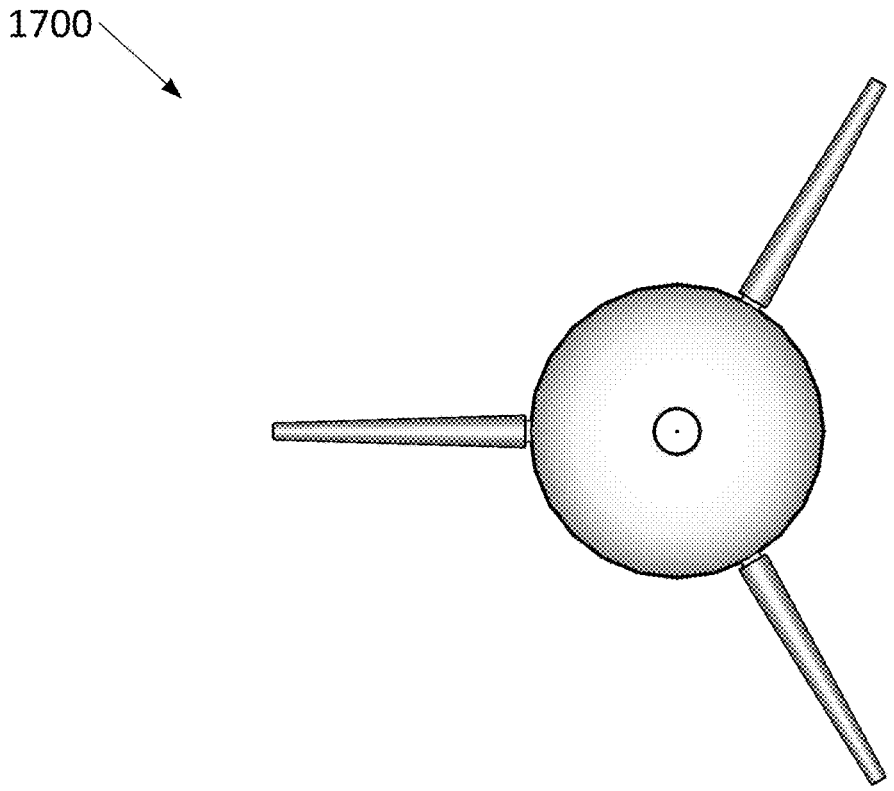
FIG. 17 illustrates a top view of a robotic fish comprising three fins, in accordance with an embodiment.

FIG. 17 illustrates a top view of robotic fish comprising three fins 1700, in accordance with an embodiment.

Figure 18:
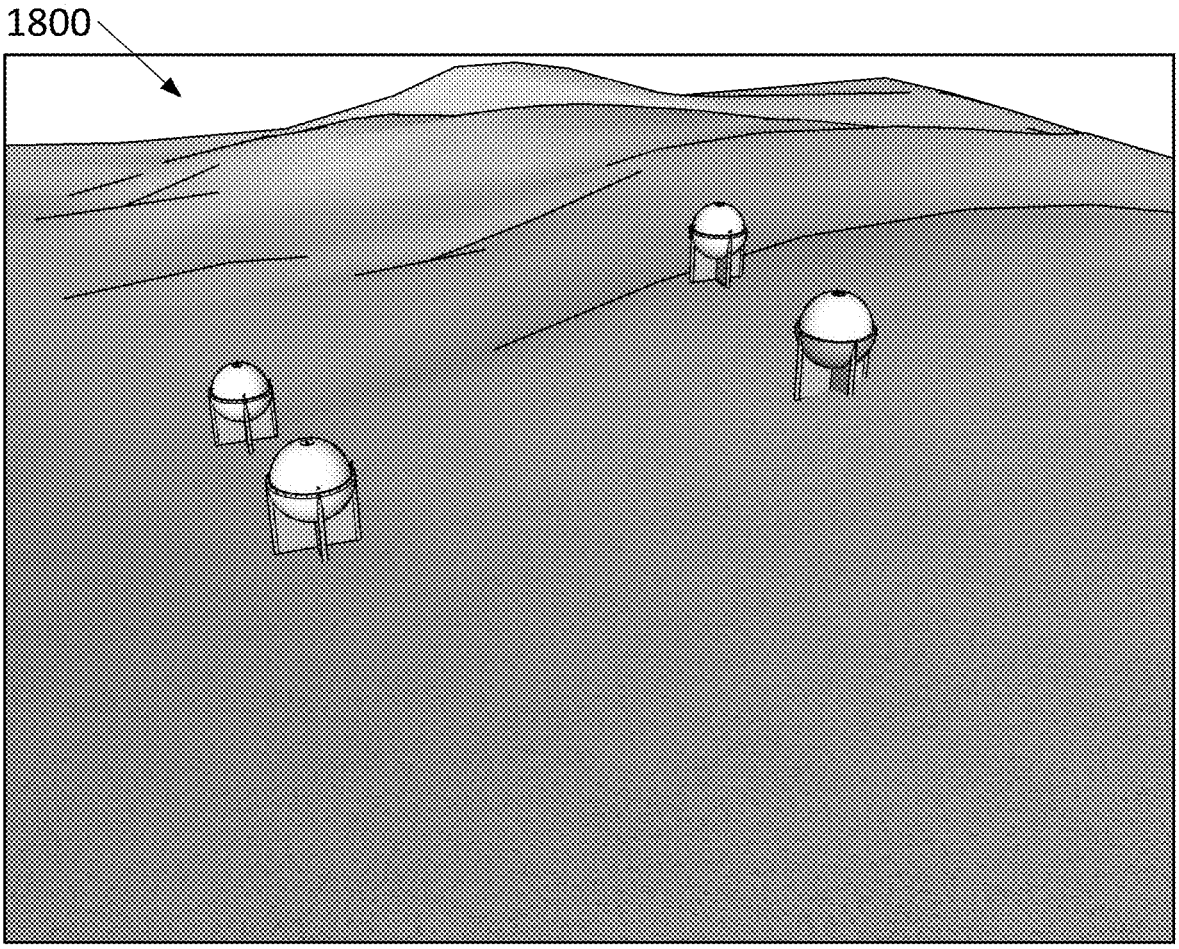
FIG. 18 illustrates an oblique view of a plurality of robotic fish on a seabed, in accordance with an embodiment.

FIG. 18 illustrates an oblique view of a plurality of robotic fish on a seabed 1800, in accordance with an embodiment.

Figure 19:
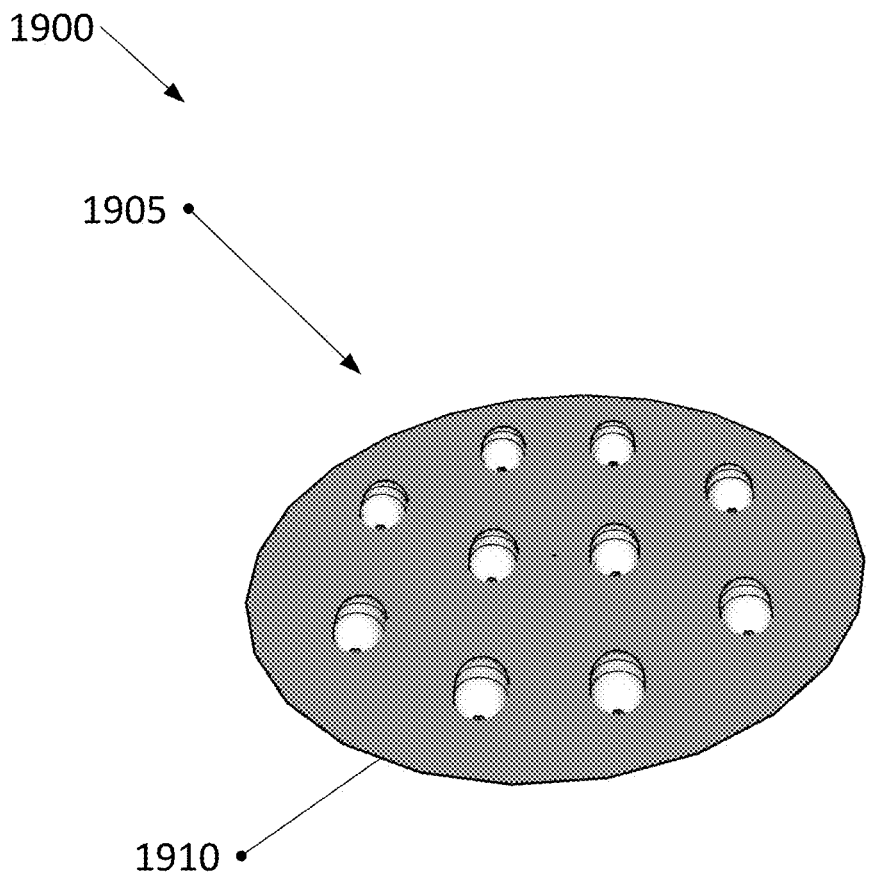
FIG. 19 illustrates a robotic fish comprising a matrix of torque reaction engines and a fin, in accordance with an embodiment.

FIG. 19 illustrates robotic fish 1900 comprising a matrix of torque reaction engines 1905 and fin 1910, in accordance with an embodiment.

Figure 20:
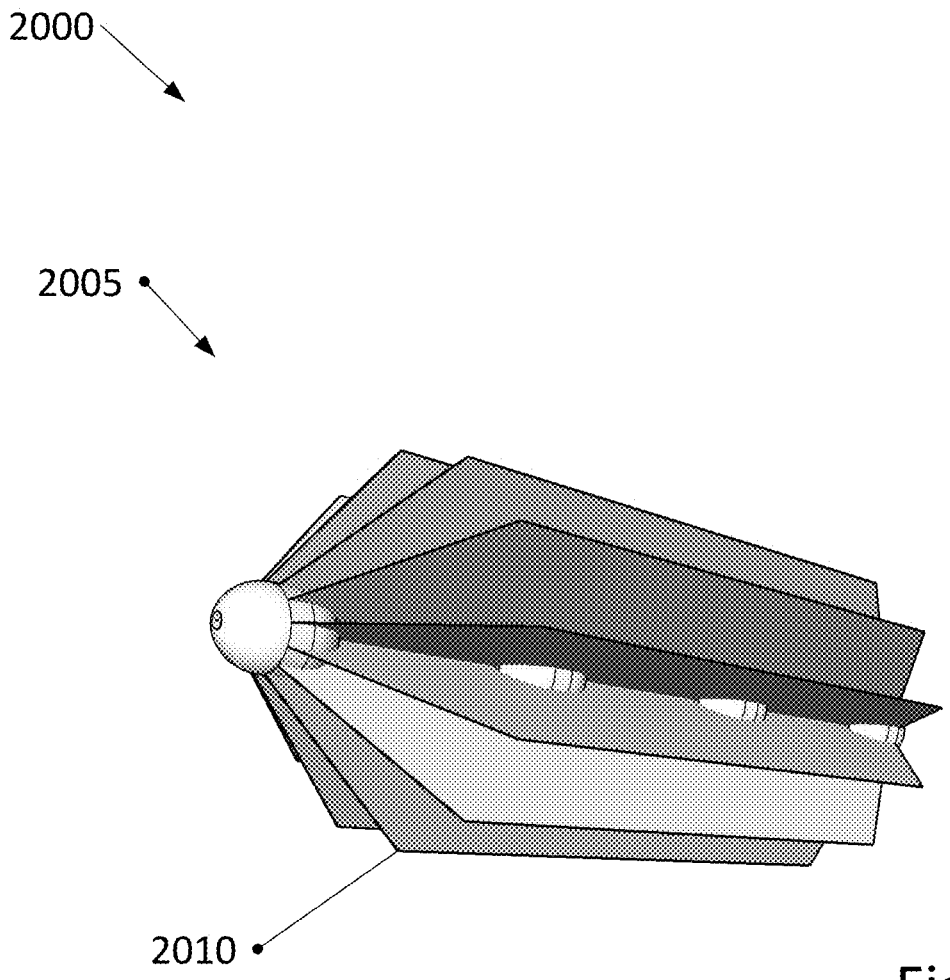
FIG. 20 illustrates a robotic fish comprising an array of torque reaction engines and a plurality of fins, in accordance with an embodiment.

FIG. 20 illustrates robotic fish 2000 comprising array of torque reaction engines 2005 and plurality of fins 2010, in accordance with an embodiment.

Figure 21:
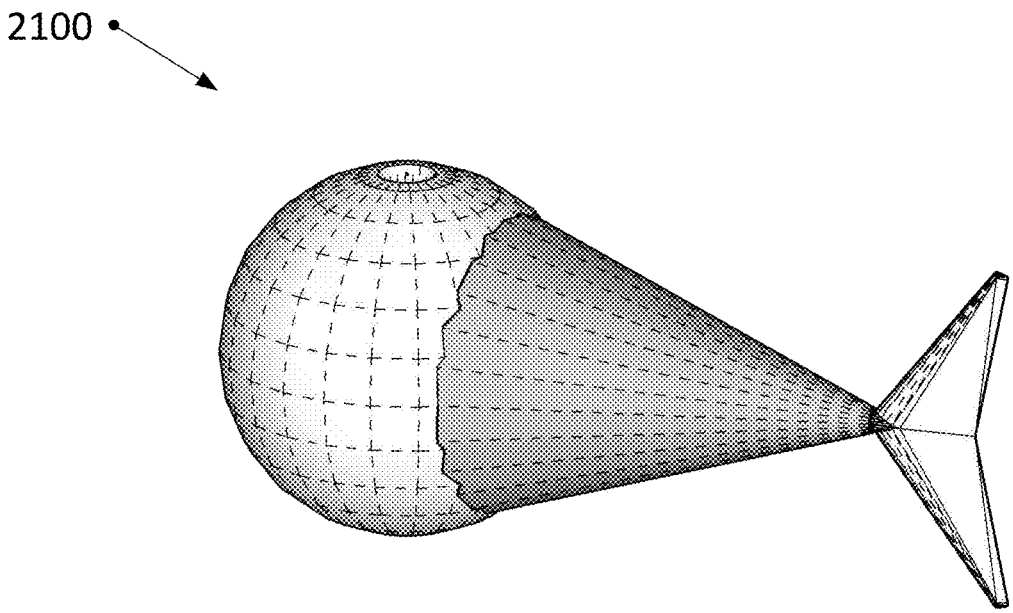
FIG. 21 illustrates a robotic fish comprising a torque reaction engine and a fin, in accordance with an embodiment.

FIG. 21 illustrates robotic fish 2100 comprising a torque reaction engine and a fin, in accordance with an embodiment.

Robotic fish disclosed herein may comprise one or motor controllers, to control cyclic oscillation of TRE. Robotic fish may comprise one or more power controllers, to control a battery pack in the inertial mass of the TRE and the supply of power to TRE. Motor controllers may include communication between motor controllers for distinct or separate TREs, such as a matrix or array of TREs. One or more of the motor controllers may be a leading motor controller and other of the motor controllers may be a following motor controller. The leading motor controller may set a pace of cyclic oscillation or may initiate cyclic oscillation in a group of motor controllers controlling the TREs. In a matrix of TREs, a plurality of TRE motor controllers may act as leading motor controllers and a plurality of TRE motor controllers may act as following motor controllers. Following motor controllers may follow behind a lead set by leading motor controllers, such as off-set by a time period, by a degree relative to a preceding motor controller or TRE of such preceding motor controller, such as 30, 45, 90, or 180 degrees, or the like.

In robotic fish comprising a matrix and an array of TREs a leading control circuit and following control circuit may establish a direction of travel of a robotic fish, wherein the leading control circuit and the following control circuit may reverse activation positions to reverse the direction of travel of the robotic fish. In a robotic fish comprising a matrix of TREs, an example of which is illustrated in FIG. 19, a control circuit may control the matrix of TREs to accelerate thrust fluid to propel the robotic watercraft in a first direction; e.g. to the left, from the perspective of a viewer of FIG. 19. The control circuit may control the matrix of TREs to accelerate thrust fluid to propel the robotic watercraft in a second direction; e.g. to the right, from the perspective of a viewer of FIG. 19. The control circuit may control the matrix of TREs to accelerate thrust fluid to propel the robotic watercraft about a central axis of the matrix of TREs; e.g. by instructing TREs on a first side of fin 1910 to operate in a first direction to produce a wave traveling left-to-right and to instruct TREs on a second side of fin 1910 to operate in a second direction to produce a wave traveling right-to-left. The control circuit may control the matrix of TREs to accelerate thrust fluid only on one side of fin 1910.

One or more of the motor controllers may receive feedback from external sensors, such as pressure sensors, acceleration sensors, acoustic sensors, ultrasonic sensors, electromagnetic sensors, proximity sensors, position sensors, bend sensors, flexure sensors, long-, medium-, and short-distance communication sensors and transceivers, and the like.

A robotic fish may comprise acoustic and chemical sensors and emitters, as well as radio frequency sensors and emitters.

Buoyancy for robotic fish may be provided at least in part by flexible material and/or by one or more displacement volume(s) within TRE. Displacement volume(s) may comprise, for example, a vacuum, a gas or a liquid that is lighter or heavier than a surrounding thrust fluid. A volume of such vacuum, gas, or liquid may be increased or decreased within the displacement volume, such as by a pump, a piston, a valve or the like. The displacement volume may, for example, occupy one or more sectors of the TRE. The vacuum, gas, or liquid may be pumped or allowed to pass between within the sectors to relocate the center of displacement of the robotic fish.

The center of mass of the robotic fish may be changed by changing the location of the TRE. Buoyancy may be adjustable, to increase or decrease buoyancy.

Robotic fish may comprise bearings. Inertial mass may comprise within the space indicated by inertial mass, a battery pack, a radial battery, a radial battery pack, lead, iron, a permanent magnet, an electromagnet, or a similar dense material. An outer shell of a TRE motor may comprise permanent magnets, electromagnets, or the like. A motor may be formed from, between, or comprise outer shell and inertial mass, wherein the motor changes a rate of acceleration of inertial mass and subjects a drive shaft of the motor to a torque reaction cause thereby, and transfers this torque reaction to the outer shell via the drive shaft. Electrical power may be transferred to a battery pack or the like within inertial mass through induction, through brushes (not illustrated), through a slip ring (not illustrated), or the like.

The invention claimed is:

1. A robotic fish comprising a wing and a plurality of torque reaction engines ("TREs") secured to the wing, wherein the plurality of TREs cause the wing to translate or rotate through and accelerate a surrounding thrust fluid, further comprising a control circuit to control the plurality of TREs, wherein the control circuit comprises an internal control circuit and an external control circuit.

2. The robotic fish according to claim 1, wherein the wing spans between the plurality of TREs and a leading end of the wing is driven by a first TRE in the plurality of TREs and a trailing end of the wing is driven by a second TRE in the plurality of TREs.

3. The robotic fish according to claim 2, wherein the trailing end is driven by the second TRE to precede or follow the leading end, wherein the leading end is driven by the first TRE.

4. The robotic fish according to claim 1, wherein the wing is a first wing and further comprising a second wing.

5. The robotic fish according to claim 1, wherein the internal control circuit is to control power to a motor of a TRE and the external control circuit is coupled to a sensor, and the external control circuit is to provide an instruction to the internal control circuit to cause the internal control circuit to control power to the motor of the TRE.

6. The robotic fish according to claim 5, wherein the sensor provides a feedback information to the external control circuit.

7. The robotic fish according to claim 1, wherein the control circuit is a first control circuit to control a first TRE in the plurality of TREs and further comprising a second control circuit to control a second TRE in the plurality of TREs.

8. The robotic fish according to claim 7, wherein the first control circuit is a leading control circuit and the second control circuit is a following control circuit.

9. The robotic fish according to claim 8, wherein the leading control circuit sets a pace of or initiates motor activation in the plurality of TREs and the following control circuit follows behind the leading control circuit.

10. The robotic fish according to claim 9, wherein the following control circuit follows behind the leading control according to at least one of a time difference, a phase difference, or an angle difference.

11. The robotic fish according to claim 10, wherein the leading control circuit and the following control circuit establish a direction of travel of the robotic fish and wherein the leading control circuit and the following control circuit reverse activation positions to reverse the direction of travel of the robotic fish.

12. The robotic fish according to claim 1 wherein the control circuit causes the TREs to cyclically oscillate.

13. The robotic fish according to claim 12, wherein cyclic oscillation of the TREs causes a wave to propagate along the wing.

14. A robotic fish comprising a wing and a plurality of torque reaction engines ("TREs") secured to the wing. wherein the plurality of TREs cause the wing to translate or rotate through and accelerate a surrounding thrust fluid, wherein at least one TRE in the plurality of TREs comprises two rotors and two stators.

15. The robotic fish according to claim 14, wherein the two stators are secured to the interior of an isolation chamber, wherein the isolation chamber surrounds the two rotors and the two stators.

* * * * *